US005491974A

United States Patent [19]

Shimmel et al.

[11] Patent Number: 5,491,974

[45] Date of Patent: Feb. 20, 1996

[54] REMOVABLE AFTERBURNER FLAMEHOLDER

[75] Inventors: Thomas J. Shimmel, Winchester; Chester J. Lamando, Jr., Nahant, both of Mass.

[73] Assignee: General Electric Company, Cincinnati, Ohio

[21] Appl. No.: 47,666

[22] Filed: Apr. 15, 1993

[51] Int. Cl.[6] ..... F02K 3/10

[52] U.S. Cl. ..... 60/261; 60/749

[58] Field of Search ..... 60/261, 749, 262, 60/39.31, 39.32

[56] References Cited

U.S. PATENT DOCUMENTS

| | | |
|---|---|---|
| 3,153,324 | 10/1964 | Meyer . |
| 3,269,116 | 8/1968 | Frasca . |
| 3,931,707 | 1/1976 | Vdoviak . |
| 4,594,851 | 6/1986 | Kushnick . |
| 4,899,539 | 2/1990 | Gastebois . |
| 4,901,527 | 2/1990 | Nash et al. . |
| 5,076,062 | 12/1991 | Abreu . |

*Primary Examiner*—Timothy S. Thorpe
*Attorney, Agent, or Firm*—Andrew C. Hess; David L. Narciso

[57] ABSTRACT

A flameholder is disclosed for use in an afterburner of an aircraft gas turbine engine. The flameholder comprises at least one annular ring and a plurality of open ended slots around the forward end of the ring with the open end of each slot open through the forward edge of the ring for accepting a plurality of fuel spraybars. One particular embodiment provides two or more sub-pluralities of slots having two or more differing axial lengths to accommodate different axially spaced sub-pluralities of spraybars such as primary and pilot spraybars. A fastening means is provided for attaching the annular ring to the outer engine casing and is accessible through the exhaust nozzle of the engine. One embodiment provides a fastening means with an anti-rotation means on a connecting link into which a bolt head may be slipped and held from rotating during torquing of a nut. Another feature of the present invention is the use of a bolt having a thread diameter smaller than the bolt shank diameter which is particularly useful when the threads are seized due to high temperature exposure. Overtorqing the nut will fail the bolt at the threads facilitating removal of the flameholder.

12 Claims, 5 Drawing Sheets

REMOVABLE AFTERBURNER FLAMEHOLDER

BACKGROUND OF THE INVENTION

1. Field of the Invention

This invention relates to an aircraft gas turbine engine afterburner flameholder and, more particularly, to a removable flameholder which can be removed from the rear of the engine through the tailpipe with the engine installed in the aircraft.

2. Description of Related Art

It is well known in the aircraft gas turbine engine art to provide thrust augmentation by burning additional fuel in an afterburner located downstream of the engine turbine. The afterburner generally includes means for dispersing a main flow of fuel together with a flameholder to which the flame may attach. The flameholder locally reduces the velocity of the gas stream and establishes a recirculation zone within the afterburner in order to sustain the flame which would otherwise blow out. The flameholder further provides an ignition zone and a low temperature rise zone which, in conjunction with fuel injected in parallel and additionally to a pilot fuel flow, provides staging to accomplish broad temperature and thrust modulation of the afterburner. One well known type of flameholder is made of sheetmetal and comprises two concentric annular flame rings arranged to diverge from each other in a downstream direction. Fuel may be introduced either uniformly upstream of the flameholder or in a plurality of locally concentrated zones so that the afterburning flame is maintained downstream of the trailing edges of the flame rings.

In order to provide for positive and uniform lightoff of the afterburner during all modes of augmented flight operation, pilot fuel may be introduced and ignited by means of a point source igniter. The pilot flame, in turn, operates to ignite the main fuel droplets. It is well known to introduce the pilot fuel to the afterburner by means of discrete jets situated around the flameholder. The pilot fuel jets are generally located intermediate the flame rings such that each pilot jet receives gas flow from the turbine exhaust through an inlet to the flameholder.

One afterburner flameholder of this type is described in U.S. Pat. No. 3,765,178 issued to Robert Hughes Hufnagle, et al. on Oct. 16, 1973, and assigned to the same assignee as the present invention. The afterburner flameholder of the Hufnagle, et al. patent includes an inner flame ring and an outer flame ring spaced radially outwardly from and concentric with the inner flame ring to form an annular flow passage for receipt of the turbine exhaust. Reference is made to the Hufnagle et al patent for backgound purposes.

Modern afterburners such as the one described in the Hufnagle, et al. patent are made from sheet metal, with elongated slots having closed semicircular ends that are conventionally referred to as racetrack shaped holes and have pilot and main spraybars inserted therethrough. The flameholder is captured by the spraybars and the spraybars must be removed before the flameholder can be removed from the engine. For many aircraft gas turbine engines, the top or upper spraybars can only be removed from the engine with the engine removed from the aircraft, such as is the case for the General Electric F404, F1O1, F11O, and J85 engines. The engine must be removed from the aircraft in order to remove the flameholder, which is a costly and time consuming procedure. A typical removal procedure for a conventional flameholder comprises:

1. Removing the engine from the aircraft;
2. Removing the main spraybars (for example, 24 or more) from the afterburner casing, including breaking fluid fitting connections to the main afterburner fuel manifold;
3. Removing pilot spraybars (for example, 6 or more) which includes breaking connections to the pilot fuel manifold;
4. Removing the igniter;
5. Unbolting the flameholder links from outside the engine; and
6. Removing the flameholder from the engine.

Upon reinstallation of the flameholder, an engine test cell checkout run must also typically be made. The main and pilot fuel systems are also flow checked prior to this test cell run. Since the integrity of all the fuel connections cannot be checked on the aircraft due to the close proximity of the top half of the engine to the aircraft structure, this test cell run is often required by government procedures and is a good operating safety practice. Presently a typical flameholder replacement requires 39 manhours worth of related steps and procedures to replace a flameholder which itself is about a 1.5 manhour job.

There is great desire to have a removable flameholder that can be removed and replaced without having to remove the engine from the aircraft or the spraybars from the engine and run the required checkout procedures discussed above. Such a flameholder is highly desirable because it improves aircraft availability and reduces yearly engine maintenance hours and engine operating costs.

SUMMARY OF THE INVENTION

An aircraft gas turbine engine flameholder operable for use with spaybars has at least one annular ring and a plurality of open ended slots around the forward end of the ring with the open end of each slot open through the forward edge of the ring. One particular embodiment provides two or more sub-pluralities of slots having two or more differing axial lengths to accommodate different axially spaced sub-pluralities of spraybars such as primary and pilot spraybars. An easily accessible fastening means for attaching the annular ring to an outer engine casing is provided and includes a rotatable link to accommodate relative thermal expansion of the ring and casing.

One embodiment provides a fastening means with an anti-rotation means on the link into which the bolt head may be slipped and held from rotating during torquing of the nut. The anti-rotation means, in an illustrative embodiment, includes a replaceable flat sided square or hex head bolt which can be inserted from the outside of the ring within a corresponding flat sided head receptacle. With the anti-rotation feature operable, the nut may be threaded onto the threaded portion of the bolt's shank and ratcheted from the inside of the ring. Alternatively, the nut could be inserted from the outside and the bolt ratcheted from the inside. Another feature of the present invention is the use of a bolt with threads smaller than the bolt shank diameter which facilitates bolt removal and is particularly useful when the threads are seized due to temperature exposure. Overtorquing the nut will fail the bolt, causing it to break off at the threads and thus afford easy removal of the flameholder. The annular ring may be an outer annular ring from which is supported an inner annular ring spaced radially inwardly of and concentric with the outer ring.

ADVANTAGES

A principal advantage of the present invention is the ability to readily remove and replace an annular flameholder from an engine while the engine remains mounted to the aircraft. The removable flameholder of the present invention substantially reduces maintenance costs and time which is particularly important during service in the field and even more important during combat service.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
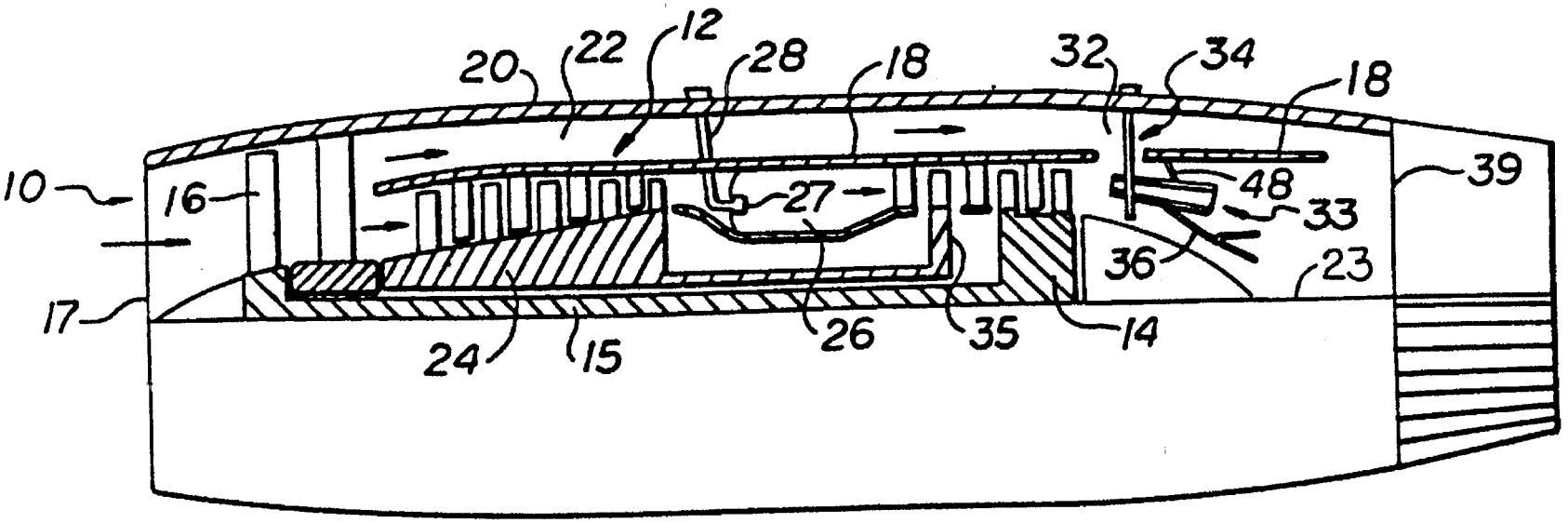
FIG. 1 is a schematic side elevational view partly in cross section of an aircraft gas turbine engine with a removable flameholder in accordance with the present invention.

Referring to FIG. 1, there is seen a turbofan engine 10 comprising a core engine 12 which generates a hot gas stream for driving a low pressure turbine 14. The turbine 14 is connected to and drives the rotor 15 of a fan 16 disposed at the inlet end 17 of the engine 10. The core engine 12 and the low pressure turbine 14 are disposed within an inner casing 18. An elongated cowl, or outer casing 20 defines the engine inlet indicated at 17 and, in combination with the casing 18, defines a duct 22, concentric with the core engine 12 about an engine centerline or axis 23.

In operation, the fan 16 pressurizes an air stream, the outer portion of which passes along the duct 22 and the inner portion of which enters the core engine 12. In the core engine 12, the air stream is further compressed by a core engine compressor 24 to provide a highly pressurized air stream for supporting combustion of fuel in a combustor 26. Fuel to the combustor 26 is provided by fuel injection means 27 which receives a flow of pressurized fuel through conduit 28 from a source of pressurized fuel (not shown). The fuel is ignited and the hot gas stream thus generated drives a high pressure, core engine turbine 35 which is connected to the rotor of the compressor 24. The hot gas stream passes through the low pressure turbine 14 and then it is intermixed with a portion of the bypass air from duct 22 entering through an annular passageway 32.

Additional thrust augmentation may be provided by the afterburner shown generally at 33. Additional fuel is introduced to the afterburner 33 through fuel inlet means 34 connecting to a source of pressurized fuel (not shown). Means for afterburner flame attachment are provided by flameholder 36, the details of which will be fully disclosed in the discussion below.

The hot gas stream exiting the afterburner 33 is discharged through a nozzle 39 to provide thrust for propulsion of an aircraft. Although the invention is described in relation to an augmented turbofan engine, it could be successfully applied to other types of augmented gas turbine engines such as a turbojet engine.

Figure 2:
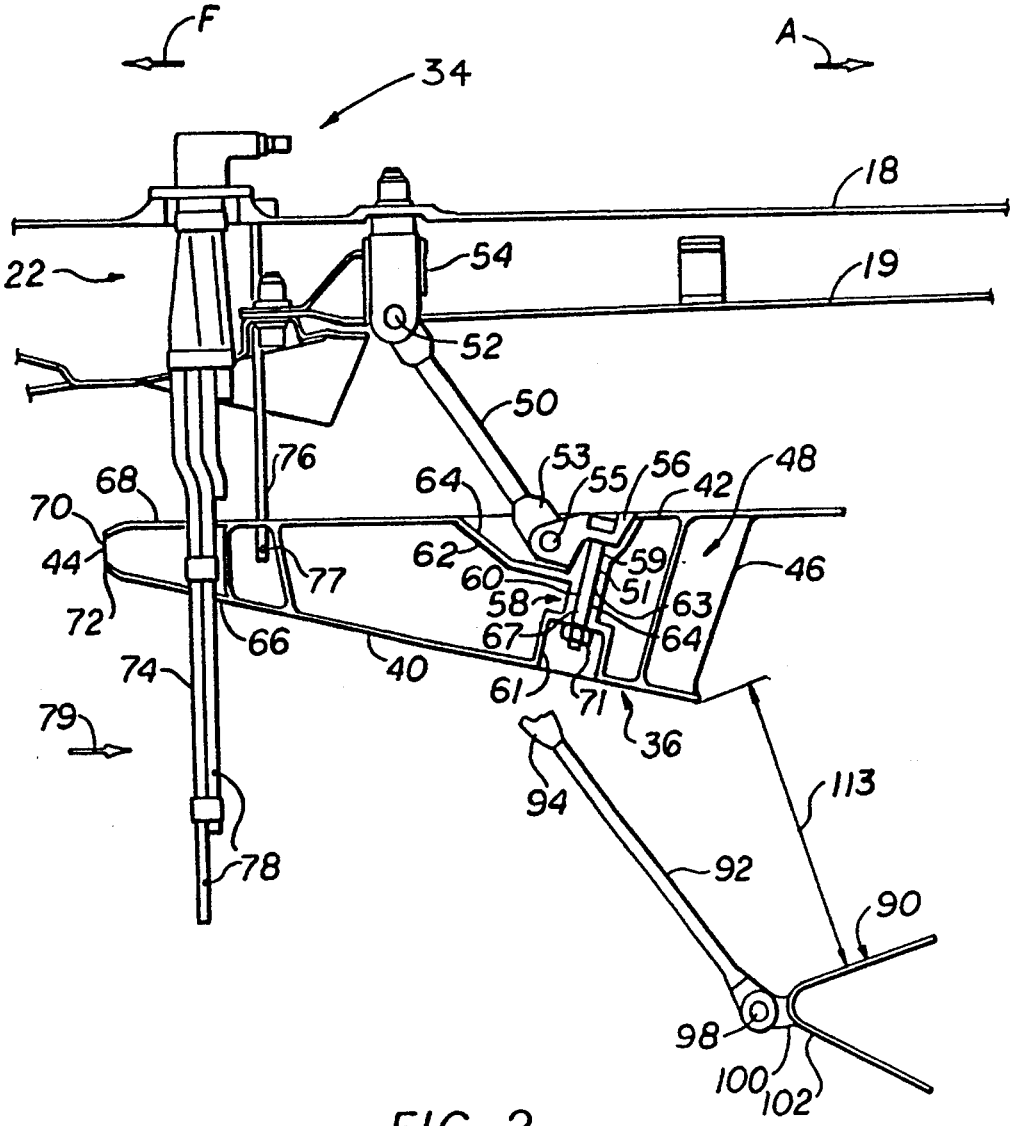
FIG. 2 is an enlarged cross-sectional view of a part of the engine containing the removable flameholder in FIG. 1 in accordance with the present invention.

Looking now to FIG. 2, where like numerals refer to previously described elements, there is seen the flameholder 36 comprising an inner frustoconical flame ring 40 and an outer frustoconical flame ring 42. The inner and outer flame rings 40, 42 are arranged in generally concentric alignment about the axis 23 so as to define an annular inlet 44 and an annular outlet 46 having greater cross-sectional area than the inlet 44. Radial separation between the flame rings is maintained by a plurality of circumferentially spaced apart and radially extending swirl vanes 48.

The flameholder 36 is attached to the inner casing 18 by means of a plurality of circumferentially spaced apart retaining links 50. The outer radial ends of the retaining links 50 are rotatably pinned at pivot 52 to flange elements 54 which are connected to the inner casing 18. A cooled liner 19 is disposed radially inwardly of and concentric with the inner casing 18 to provide thermal isolation thereof. The radial inner end 53 of each retaining link 50 is rotatably pinned to the flame holder 36 at pivot 55 which has a flat sided bolt head receptacle 56, which serves as an anti-rotational bolt head holder for a bolt 59 disposed through a link aperture 51.

In order to accommodate rotation of the retaining link 50 about the pivot 55, a notch 62 is provided through the outer flame ring 42. The outer radial end 64 of the notch 62 is radially skewed in the axial direction. The pivotal feature of the retaining links 50 is provided to accommodate thermal expansion of the flameholder 36 relative to the inner casing 18. The number of retaining links 50 may be varied to suit particular engine requirements with a minimum of three retaining links spaced apart at equal angular intervals.

Figure 4:
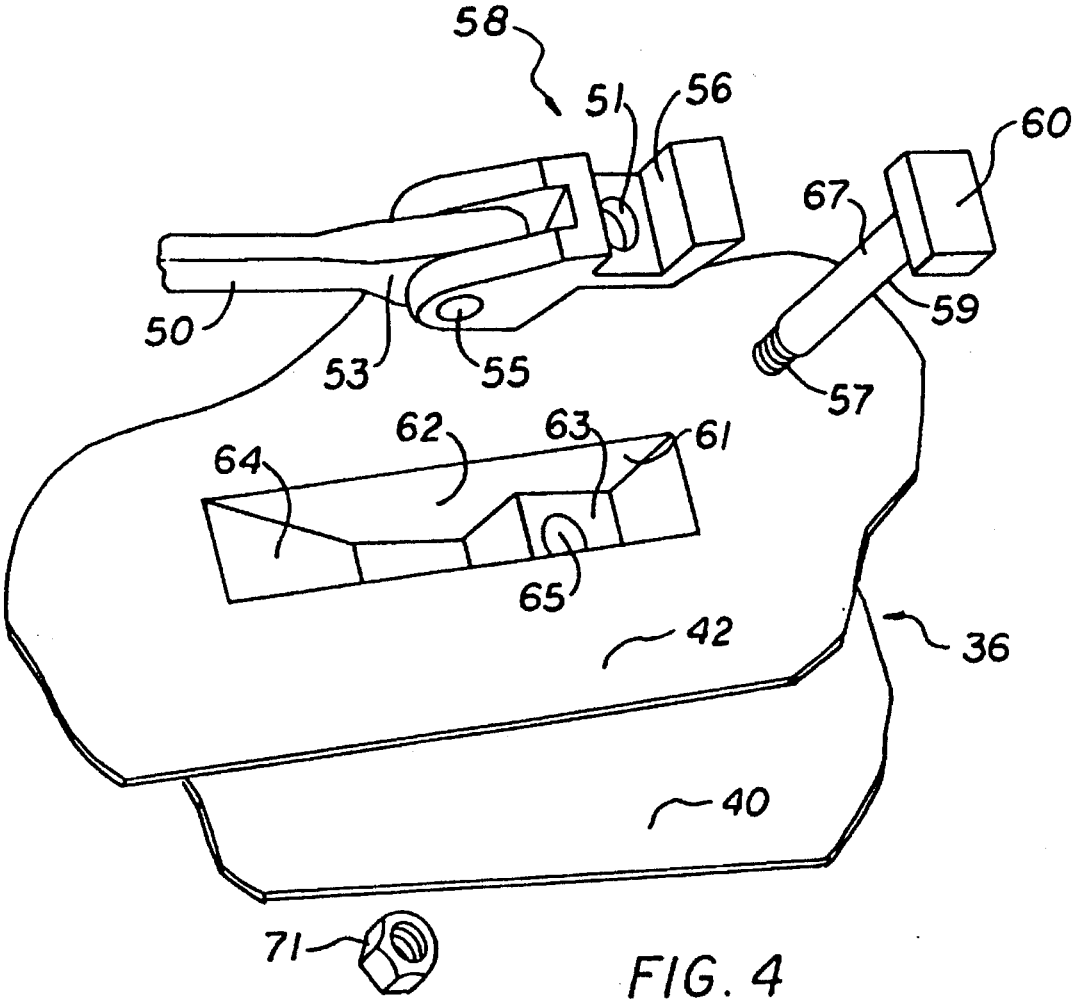
FIG. 4 is an exploded perspective view of the flameholder's mounting means including the bolt and link of the removable flameholder in FIG. 2.

Referring to FIG. 4, the bolt 59 and the receptacle 56 illustrate a radially inwardly removable fastening means 58 feature of the present invention wherein the receptacle 56 is operable to receive a corresponding flat sided bolt head 60 of the bolt 59. The flat sided receptacle 56 is disposed within a similarly configured sleeve 61 which extends through the outer flame ring 42 and which has a bottom flange portion 63. The flange portion 63 has flange aperture 65 through which the bolt shank 67 of the bolt 59 is disposed. The bolt 59 is secured by a nut 71.

Figure 3:
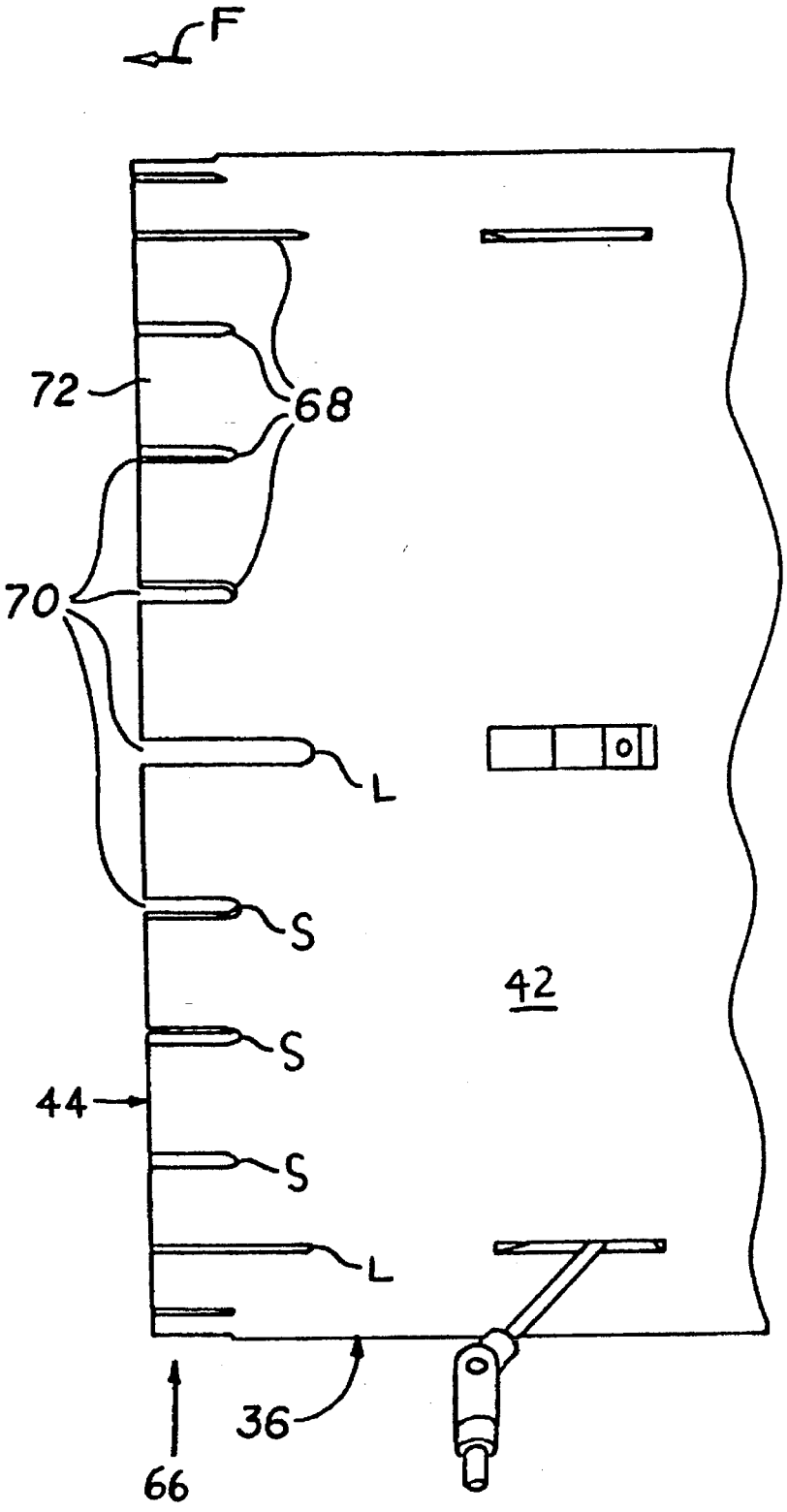
FIG. 3 is a partial side view of the forward end of the removable flameholder in FIG. 2.

Adjacent the flameholder annular inlet 44, along an annular forward portion 66 of the flameholder 36, there is disposed a plurality of circumferentially spaced apart and axially extending open ended slots 68 in the flameholder 36, as can readily seen in FIG. 3. The open ended slots 68 have forward facing openings 70 in a forward edge 72 of the flameholder 36. The afterburner fuel inlet means 34 includes a plurality of main fuel spraybars 74 which extend radially through the open ended slots 68 of the flameholder 36. Each main fuel spraybar 74 includes a plurality of apertures 78 for the discharge of main jet streams of fuel. The apertures 78 are spaced radially apart and oriented so as to discharge main jet streams of fuel in directions generally parallel to the core gas stream direction indicated by an arrow labelled 79.

A pilot fuel conduit 76 terminates between the inner and outer flame rings 40, 42. Each pilot fuel conduit 76 typically includes two circumferentially spaced apart apertures 77, wherein one aperture 77 cannot be seen since it is angled away from the view shown. The pilot fuel conduits 76 are disposed in longer open ended slots 68 labelled L in FIG. 3 than the shorter open ended slots 68 labelled S in FIG. 3 through which the main fuel spraybars 74 extend. All slots have forward facing openings 70 in a forward edge 72 of the flameholder 36. Note that each of the longer and shorter slots L,S extend through both the inner flame ring 40 (shown in FIG. 2) and the outer flame ring 42.

Referring back to FIG. 2, an annular V-gutter assembly 90 is shown out of plane. Assembly 90 is mounted to the inner ring 40 by a plurality of circumferentially spaced apart retaining links 92. The upstream ends 94 of the retaining links 92 are rotatably pinned at a pivot (not shown) to flange elements (not shown) attached to the radially inner wall of ring 40. The downstream ends of retaining links 92 are rotatably pinned at pivot 98 to flange elements 100 which are fixedly connected to the exterior annular wall of a forward portion of the annular V-gutter 102. The V-gutter 102 is retained adjacent to but separate from the inner ring 40 by retaining links 92 in order to permit relative thermal growth between the inner ring 40 and V-gutter 102 since, in operation, the temperature of V-gutter 102 may vary significantly from the temperature of the ring 40. An annular passage 113 between the inner ring 40 and annular V-gutter 102 is provided to establish a flow within the passage 113 that maintains the flame downstream of V-gutter 102.

FIG. 4 illustrates the removable fastening means 58 operable to be disposed within the notch 62 so as to allow the inner radial end 53 to pivot within the outer radial end 64 of the notch 62. The bolt 59 disposed through the link aperture 51 and the flange aperture 65 and secured by the nut 71 fastens the link 50 to the flange 63. A useful feature of the present invention provides for the bolt 59 having threads 57 that are smaller in diameter than the main diameter of the bolt shank 67. This allows the nut 71 to be ratcheted so as overtorque the bolt 59 and cause the bolt 59 to break off at the threads 57. This feature is useful to remove a nut which may have seized threads due to temperature exposure.

In operation, with the flat sided bolt head receptacle 56 in place in the notch 62, the bolt 59 can be inserted from the outside of the flameholder 36 through the link aperture 51 and the flange aperture 65. The bolt 59 can be fastened by the nut 71 with the receptacle 56 preventing rotation of the bolt 59. Ratcheting of the nut 71 can be done from inside of the flameholder 36. To remove the bolt 59, the nut 71 can be unthreaded from the threads 57 of the bolt 59 or if necessary overtorqued, which will break off the bolt at the threads 57. The flameholder 36 can then be removed and a new flameholder 36 inserted using new nuts 71 and bolts 59. Thus, the flameholder 36 can be attached to the retaining links 50 from inside the engine 10, the open ended slots 68 allowing the flameholder 30 to be axially inserted around the spraybars 74 without disturbing them. These features in combination allow a flameholder 36 to be attached to the engine 10 with nuts 71 accessible from inside the engine 10, and afford removability and insertability without disturbing either the main or pilot spraybar systems. Thus no precautionary test cell run or spraybar flowcheck would be necessary as the main and pilot afterburner fuel systems would not be disturbed.

Figure 4A:
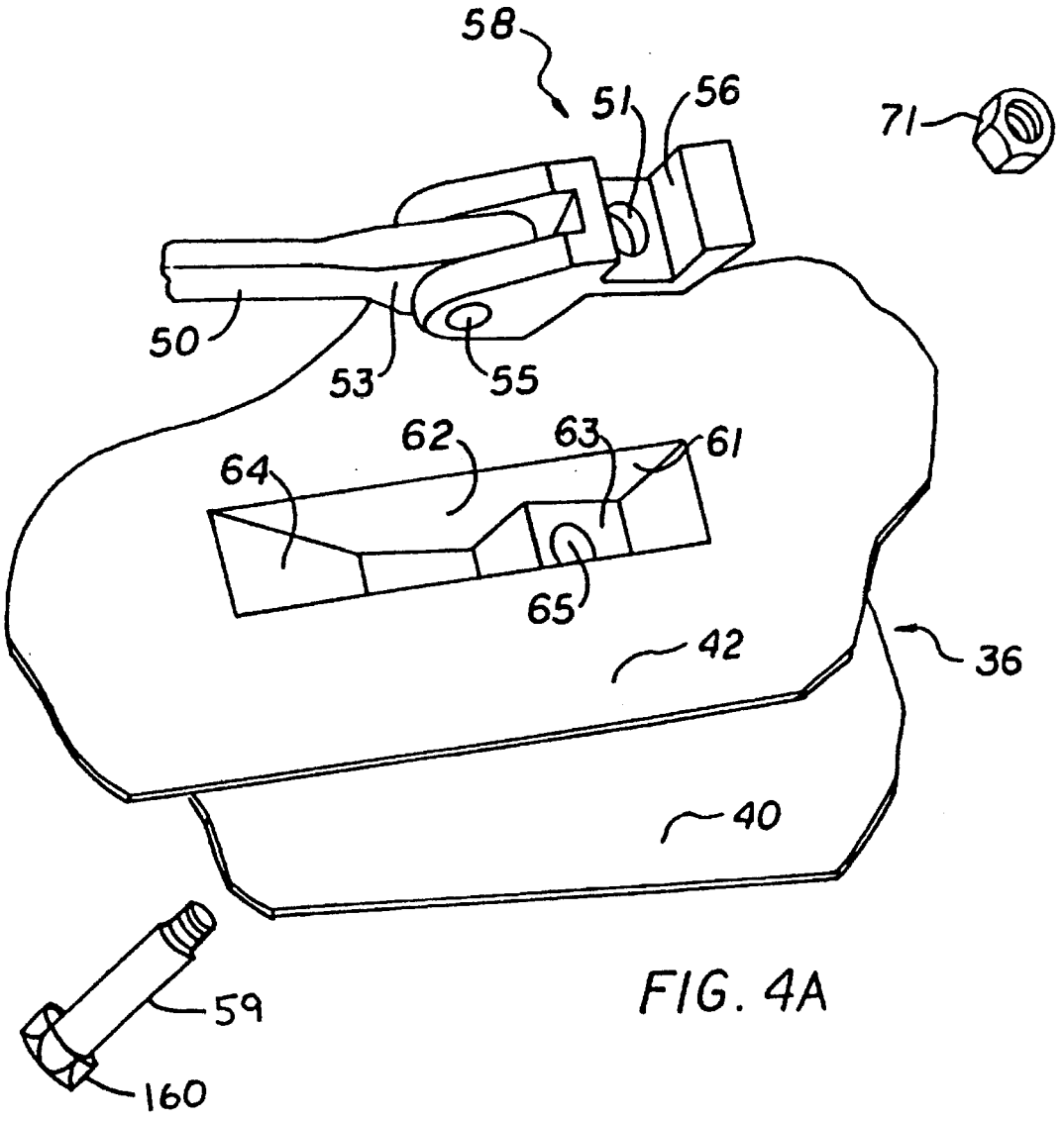
FIG. 4A is an alternate embodiment of the invention shown in FIG. 4.

It will be understood by those skilled in the art that modifications and changes of an obvious nature can be made and that the invention applies to a variety of exhaust afterburner flameholders and assembly thereof. For example, bolt 59 could have a conventional hex head 160 which could cooperate with receptacle 56 to provide anti-rotation in a manner similar to that of the flat sided head 60. Alternatively, a square or hex shaped nut 71 could be received in the receptacle 56 and secured by a bolt 59 extending radially outwardly through the flameholder 36 as depicted in FIG. 4A. The appended claims are intended to cover all such modifications and changes.

We claim:

1. A flameholder for use in an aircraft gas turbine engine afterburner having spraybars for introducing fuel into the afterburner, said flameholder comprising:

an annular flameholder circumscribed about an axis and having a forward end upstream of an aft end with respect to a downstream airflow direction of the afterburner, a plurality of open ended slots circumferentially disposed around said forward end, and a plurality of corresponding open ends of said slots that are open through a forward edge of said forward end.

2. A flameholder as claimed in claim 1 wherein said plurality of open ended slots comprise at least two sub-pluralities of open ended slots wherein said slots of each sub-plurality have a different axial length.

3. A flameholder as claimed in claim 2 wherein said annular flame holder comprises two annular flame rings.

4. A flameholder as claimed in claim 2 wherein said flameholder further comprises:

an outer frustoconical flame ring and an inner frustoconical flame ring disposed within said outer ring, said inner and outer flame rings being arranged in general concentric alignment so as to define an annular inlet and an annular outlet of greater cross-sectional area than said inlet.

5. A flameholder assembly for use in an afterburner having spraybars for introducing fuel into the afterburner of an aircraft gas turbine engine having an exhaust nozzle aft of the afterburner, said flameholder assembly comprising:

an annular flameholder circumscribed about an axis and having a forward end upstream of an aft end with respect to a downstream airflow direction of the afterburner, a plurality of open ended slots circumferentially disposed around said forward end, a plurality of corresponding open ends of said slots that are open through a forward edge of said forward end, and mounting means including fastening means that is accessible through the exhaust nozzle of the engine.

6. A flameholder assembly for use in a afterburner having spraybars for introducing fuel into the afterburner of an aircraft gas turbine engine having an exhaust nozzle aft of the afterburner, said flameholder assembly comprising:

an annular flameholder having a forward end, a plurality of open ended slots circumferentially disposed around said forward end, a plurality of corresponding open ends of said slots that are open through a forward edge of said forward end, mounting means including fastening means that is accessible through the exhaust nozzle of the engine, and said mounting means comprises a plurality of rotatable retaining links connected to said flameholder by said fastening means and said each of said fastening means comprises;

a bolt having a bolt head and said bolt being disposed through a first aperture in a member of said link, an anti-rotation means disposed about said first aperture, said bolt being secured to said flame holder by a nut, one of said bolt head and said nut being anti-rotationally engaged by said anti-rotation means, and the other of said bolt head and said nut being accessible from interior of said flameholder.

7. A flameholder assembly as claimed in claim 6 wherein said bolt comprises a shank having said bolt head at a proximal end and a threaded portion at a distal end and an unthreaded portion therebetween, said threaded portion being engaged by threads of said nut and having a first diameter, and said unthreaded portion having a second diameter, wherein said first diameter is sufficiently smaller than said second diameter so as to preferentially fracture said threaded portion with said nut during overtorquing of said fastening means.

8. A flameholder assembly as claimed in claim 7 wherein said annular flame holder comprises:

two radially spaced apart annular inner and outer flame rings having a circumferentially disposed plurality of radially extending sleeves radially connecting said flame rings, each sleeve having a notch through said outer flame ring with an outer radial end of said notch radially skewed in the axial direction, each link disposed within one of said sleeves, a flange connected to and disposed across said sleeve, and said bolt disposed through a second aperture in said flange.

9. An afterburner for use in an aircraft gas turbine engine having an exhaust nozzle aft of the afterburner, said afterburner comprising:

an annular casing, a plurality of spraybars disposed circumferentially about and projecting radially through said casing for introducing fuel into the afterburner, a flameholder assembly comprising;

an annular flameholder having a forward end, a plurality of open ended slots circumferentially disposed around said forward end wherein each plurality of spraybars is radially disposed through one of said plurality of open ended slots, a plurality of corresponding open ends of said slots that are open through a forward edge of said forward end, a mounting means disposed between said flameholder and said casing, and said mounting means including a fastening means that is accessible through the exhaust nozzle of the engine.

10. An after burner as claimed in claim 9 wherein said mounting means comprises a plurality of rotatable retaining links connected to said flameholder by said fastening means and each of said fastening means comprises;

a bolt having a bolt head, said bolt being disposed through a firs aperture in a member of said link, an anti-rotation means disposed about said first aperture, said bolt being secured to said flameholder by a nut, one of said bolt head and said nut anti-rotationally engaged by said anti-rotation means, wherein said bolt comprises a shank having said bolt head at a proximal end and a threaded portion of said shank at a distal end and an unthreaded portion therebetween, said threaded portion being engaged by threads of said nut and having a first diameter, and said unthreaded portion having a second diameter, wherein said first diameter is sufficiently smaller than said second diameter so at to preferentially fracture said threaded portion with said nut during overtorquing of said fastening means.

11. An afterburner as claimed in claim 10 wherein said annular flame holder comprises:

two radially spaced apart annular inner and outer flame rings having a circumferentially disposed plurality of radially extending sleeves radially connecting said flame rings, each sleeve having a notch through said outer flame ring with an outer radial end of said notch radially skewed in the axial direction, each link disposed within one of said sleeves, a flange connected to and disposed across said sleeve, and said bolt disposed through a second aperture in said flange.

12. An afterburner as claimed in claim 11 wherein said plurality of open ended slots comprise at least two sub-pluralities of open ended slots wherein said slots of each sub-plurality have a different axial length.

* * * * *